United States Patent [19]

Bauer

[11] 4,308,716

[45] Jan. 5, 1982

[54] APPARATUS FOR APPLYING LIQUID TO A RUNNING YARN

[75] Inventor: Karl Bauer, Remscheid, Fed. Rep. of Germany

[73] Assignee: Barmag Barmer Maschinenfabrik AG, Remscheid, Fed. Rep. of Germany

[21] Appl. No.: 167,059

[22] Filed: Jul. 9, 1980

[30] Foreign Application Priority Data

Jul. 10, 1979 [DE] Fed. Rep. of Germany ..... 2927741

[51] Int. Cl.[3] ..... D01H 13/20; D01H 13/26

[52] U.S. Cl. ..... 57/286; 57/291; 57/295; 118/212; 118/DIG. 15; 427/428

[58] Field of Search ..... 427/428; 68/202; 57/295, 296, 291; 118/212, 229, 246, 234, 220, DIG. 20, DIG. 15

[56] References Cited

U.S. PATENT DOCUMENTS

| | | | |
|---|---|---|---|
| 1,384,940 | 7/1921 | Denison | 118/DIG. 20 |
| 1,578,241 | 3/1926 | Johnson | 68/202 |
| 1,914,488 | 6/1933 | Custers | 118/DIG. 20 |
| 2,271,999 | 2/1942 | Gariepy | 118/234 X |
| 2,331,207 | 10/1943 | Lodge | 118/234 |
| 2,673,546 | 3/1954 | Newton | 118/246 X |
| 3,288,106 | 11/1966 | Heiseler | 118/246 X |
| 3,650,242 | 3/1972 | Mahoney | 118/246 |
| 3,762,365 | 10/1973 | Herzog | 118/212 |

FOREIGN PATENT DOCUMENTS

| | | | |
|---|---|---|---|
| 741767 | 5/1943 | Fed. Rep. of Germany . | |
| 44963 | 5/1908 | Switzerland . | |
| 1374620 | 11/1974 | United Kingdom . | |
| 1403935 | 8/1975 | United Kingdom . | |
| 282596 | 1/1971 | U.S.S.R. | 118/234 |

*Primary Examiner*—Shrive P. Beck

*Attorney, Agent, or Firm*—Bell, Seltzer, Park & Gibson

[57] ABSTRACT

An apparatus and method are provided for applying liquid to a yarn running at high speed, and with a relatively low resistance being imparted to the yarn during the application. The apparatus includes a roller partially immersed in a liquid bath, and having a circumferential surface composed of alternating lands and grooves in the circumferential direction. Means are provided for rotating the roller and for guiding the running yarn tangentially across the top portion of the roller, and such that the yarn advances at a linear speed substantially greater than the peripheral speed of the roller. The yarn guiding means is adjustable to permit the extent of the contact between the yarn and the top of the roller to be varied.

6 Claims, 7 Drawing Figures

APPARATUS FOR APPLYING LIQUID TO A RUNNING YARN

The present invention relates to an improved apparatus and method for applying a liquid to a running yarn, and more particularly, to an apparatus and method for applying a liquid to each of the yarns on a false twist yarn crimping machine or the like and with low resistance being imparted to the yarns.

Devices for applying a finishing liquid to running yarns in textile machines are known. Typically, the yarn is guided over a roller driven at a variable speed, with the roller being immersed in a liquid bath or being continuously coated by a stream of the liquid. The roller thereby carries the liquid along on its circumference and transfers the liquid to the yarn as it moves along the upper portion of the circumference of the roller.

The above liquid applying system presents difficulties when it is attempted to run the yarn at high speed under minimal tension. In particular, with increasing yarn speed, correspondingly increasing forces act upon the yarn. These increasing forces result not so much from mechanical friction, but rather from hydraulic forces, which are highly dependent on speed and viscosity. Prior attempts have been made to keep the viscosity of the liquid as low as possible in order to minimize the resistance forces. However, there are practical reasons why the reduction of the viscosity must be limited, including the fact that the formation of a sufficiently thick film of the liquid on the surface of the wetting roller must be achieved, as well as the fact that the composition and intended function of the yarn may require that the finishing liquid meet certain requirements determined by the viscosity of the liquid.

It has been found that when the relative speed between a running yarn and the roller exceeds about 500 to 600 meters per minute, and the tension of the yarn drawn off from the wetting roller amounts to only a few centi Newton (such as 4 cN), the yarn will start to sag immediately upstream of the wetting roller. As a specific example, this problem is present in false twist yarn crimping machines and the like, and in which the crimped and set yarns receive a coating of liquid after they have passed the final feed system, and before they are wound onto take-up spools. Usually, the crimped yarn is wound under very little tension so as not to damage the crimp and to ensure good bobbin build-up. At the same time, the industry today demands yarn speeds exceeding one thousand meters per minute, and the circumferential speed of the finishing roller with a diameter up to 100 millimeters amounts to approximately one to ten meters per minute, depending on the denier, the crimp in the yarn, the viscosity of the finishing liquid, the required amount of the liquid to be applied, as well as the yarn speed.

At the present time, each working station of a conventional false twist yarn crimping machine is usually equipped with a yarn detector, which stops processing of the yarn when for example, an end is down in the texturinzing or the post treatment zone. The processing is typically stopped by cutting the yarn as it leaves the delivery package and before it enters the first feed zone, to thereby avoid clogging the machine with unwound yarn. If sagging of the yarn should occur, dangerous lap-ups may develop at the final feed station, and also, the yarn detector may trigger an interruption signal to stop the processing of the yarn. In other textile processing machines equipped with a liquid wetting system, such as spinning or spin-draw machines, a fluttering of the yarn may develop as a result of the decrease of the yarn tension before it enters the wetting apparatus, and other undesirable effects may also develop such as slippage through the draw rolls.

It is accordingly an object of the present invention to provide an apparatus and method for applying a liquid to a running yarn which imparts a very low resistance to the yarns, and such that a false twist yarn crimping machine or the like which includes the liquid applying apparatus may be run at high yarn speeds and low yarn tension.

These and other objects and advantages of the present invention are achived in the embodiments illustrated herein by the provision of a liquid applying apparatus and method which includes a roller mounted for rotation about a fixed axis and having a circumferential surface composed of alternating lands and grooves in the circumferential direction. Means are provided for rotating the roller about its rotational axis, and for guiding the running yarn so as to tangentially contact the lands along a portion of the circumferential surface of the roller. Also, means are provided for applying a liquid to the circumferential surface of the roller during rotation thereof. The running yarn has a linear speed substantially greater than the peripheral speed of the roller, typically at least fifty times greater, and thus the liquid is transferred to the running yarn and applies a substantially uniform coating as the yarn moves along the circumferential surface of the rotating roller.

In one embodiment the lands and grooves are constructed in the manner of gear teeth, and such that the running yarn contacts only the lands (i.e., the top surface) of the teeth. The grooves between the lands have a length measured in the circumferential direction such that they comprise between about one-third to two-thirds of the total circumference of the roller. Commercially available toothed belt pulleys or spur gears may be used as the wetting roller, and which have a ratio of land (or tooth) length to groove length of approximately one to one measured in the circumferential direction.

Generally, any type of interrupted surface may be used as the contact surface of the wetting roller. Thus for example, the wetting roller may be a tooth belt pulley, a spur, helical, or herringbone gear, a spiral or worm gear, or a toothed bevel gear, or toothed double bevel gear. Also, the surface of the roller may be defined by radial bored holes, or by a perforated sheet of metal which is attached to the circumference of the roller. Since the relative speed between the yarn and the circumference of the roller is in any event high, the roller may, in accordance with the present invention, be rotated in either direction with respect to the yarn movement. Also, it is not necessary that the yarn contact the peripheral surface of the roller along a significant distance or looping angle. The looping angle preferably should not exceed about 30 degrees. Due to the fact that the roller is provided with grooves or that its surface is interrupted, a sufficiently high volume of liquid being applied on the surface of the roller is ensured. Also, the interrupted construction of the circumferential surface of the roller ensures that no continuous film of liquid develops on the circumference. In this regard, it appears that the hydraulic resistance of the liquid carried by the yarn surface is considerably less with the present invention than in the case of a continuous cylindrical surface of the wetting roller. Applying an equal amount of fluid on the yarn, it is thus possible to reduce the resistance force applied to the yarn, so that laps or other entanglement of the yarn is avoided, and unintentional interruptions of the yarn processing operation by actuation of the yarn detector is avoided. The amount of liquid applied, and the yarn tension, can be extensively influenced by the construction of the roller, as well as by the adjustment of the circumferential speed. In tests run to date, it was found that a relatively small number of lands (or teeth) for a given circumference lead to better results. In particular, it was found that the lands should preferably measure at least three millimeters. Otherwise, an insufficient application of the liquid may be obtained. Also, the pitch or circumferential length of the groove should be selected so as to be smaller than the length of the yarn in contact with the circumference of the roller i.e., the circumferential length defined by the looping angle. Otherwise, an unequal application of the liquid and uneven yarn tension will be obtained.

In the case of a roller having a diameter of 69 millimeters, 23 teeth, and a ratio of the sum of the length of the lands of the teeth to the sum of the length of the grooves equaling one to one, and operating at 12 rpm, a liquid application of 1.19% of the yarn weight was achieved. At 20 rpm, 2.96% of the yarn weight was applied. Sagging of the yarn approaching the roller was avoided to a substantial degree. The ratio between the tension of the yarn drawn off and the tension of the yarn approaching the roller amounted in each case to 8 cN to 4 cN. In this example, a 78 dtex (Dezitex) polyester yarn was crimped by a false twisting operation and received an application of liquid before it was wound at 600 meters per minute.

The apparatus of the present invention is adapted for use in all such textile machines in which an oiling of the yarn is desired. However, the apparatus of the present invention is particularly suitable for use in textile machines in which the finishing liquid must be applied at high yarn speeds, such as spinning, spin-draw and spin-draw-texturing machines.

Some of the objects and advantages of the invention having been stated, others will appear as the description proceeds, when taken in connection with the accompanying drawings, in which FIG. 1 is a somewhat schematic side elevation view of a false twist yarn crimping machine which embodies the present invention;

Figure 1:
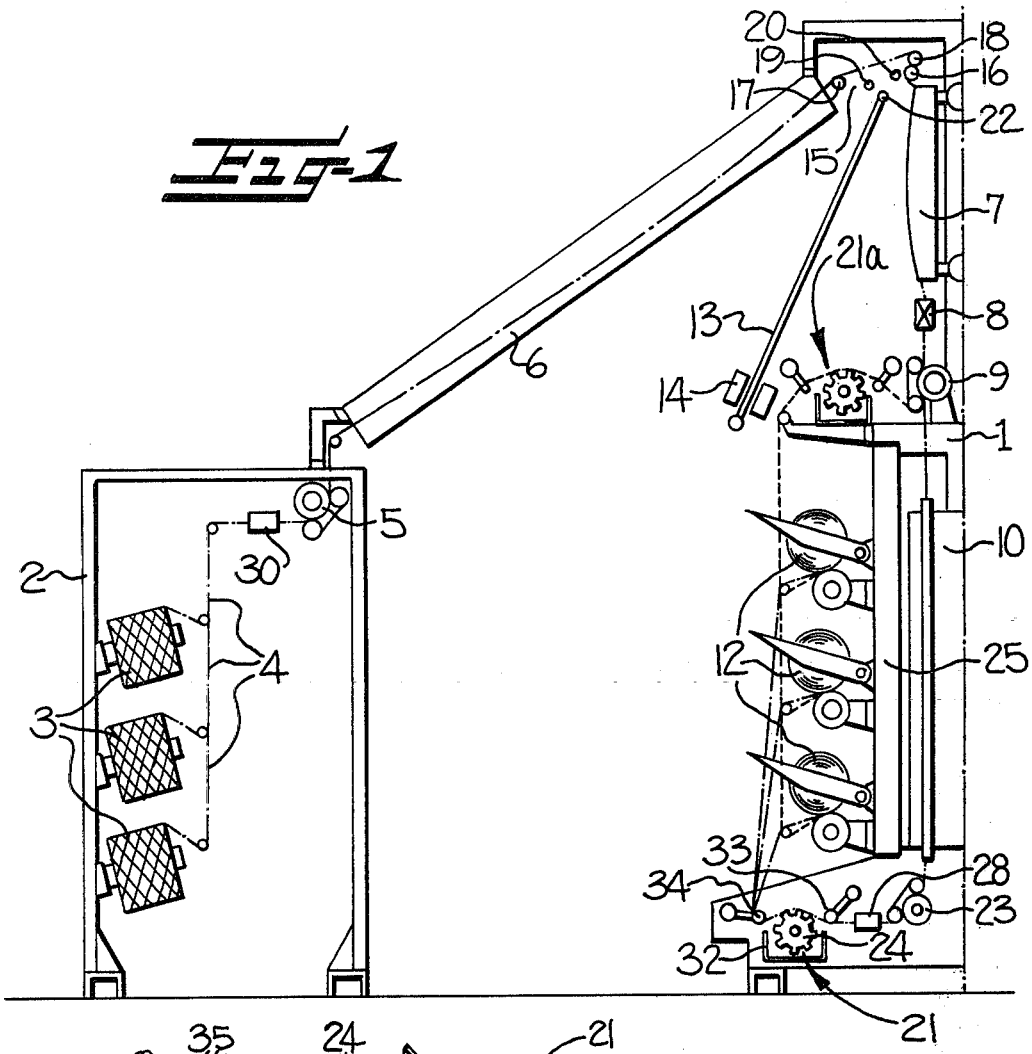
FIG. 1 illustrates somewhat schematically the left half of a false twist yarn crimping machine, having a central frame 1 and a side frame 2. The right half of the machine is not illustrated, and is a mirror image of the illustrated left half.

Side frame 2 carries a number of delivery packages 3 upon which synthetic yarns 4 are wound. A feed device 5 draw each yarn from its package 3, and then past a yarn cutter 30 located between the delivery packages 3 and the feed device 5. From the feed device 5, the yarn is guided along a curved heater plate 6, one end of which is attached to the side frame 2 and the other end of which is attached to the central frame 1. The operative surface of the heater plate 6 which is contacted by the yarn faces toward the center aisle between the side frame 2 and central 1. From the heater plate, which is preferably suitably insulated and sealed on the lower side by a closable cover, the yarn is deflected and conducted over a cooling plate 7 which has a cooling medium, such as water, circulating therethrough. After having passed the cooling plate, the yarn reaches a false twist unit 8, which may for example comprise a false twist spindle or a friction false twist assembly.

The yarn is removed from the false twist zone by a take-off mechanism 9. The circumferential speeds of the feed device 5 and take-off mechanism 9 are adjusted in such a manner that the yarn is under a desired tension while in the false twist zone. If desired, the yarn may be suitably stretched or drawn in the false twist zone by a suitable mechanism. From the take-off mechanism, the yarn may be conducted across the liquid applying apparatus 21*a* (with the yarn path being indicated by dashed lines in FIG. 1) or through an additional heater 10 and across the second like liquid applying apparatus 21. In either case, the yarn is next delivered to the winding station which is mounted on the plate 25 of the central frame 1. In the illustrated embodiment, there are three yarn delivery packages 3, as well as three take-up packages 12. In this regard, it should be noted that the three yarns 4 delivered from the yarn delivery packages 3 are guided side-by-side in the longitudinal direction of the machine throughout the process and each of the yarns passes through a separate false twisting device.

The heating of the yarn in the zone of heater 10 is preferably effected without the yarn contacting any surface. This may be accomplished by passing the yarn through a heater in the form of a heated tube. After passing through the heater 10, the yarn is drawn off by the further take-off mechanism 23 which supplies the yarn to the winding station.

Figure 2:
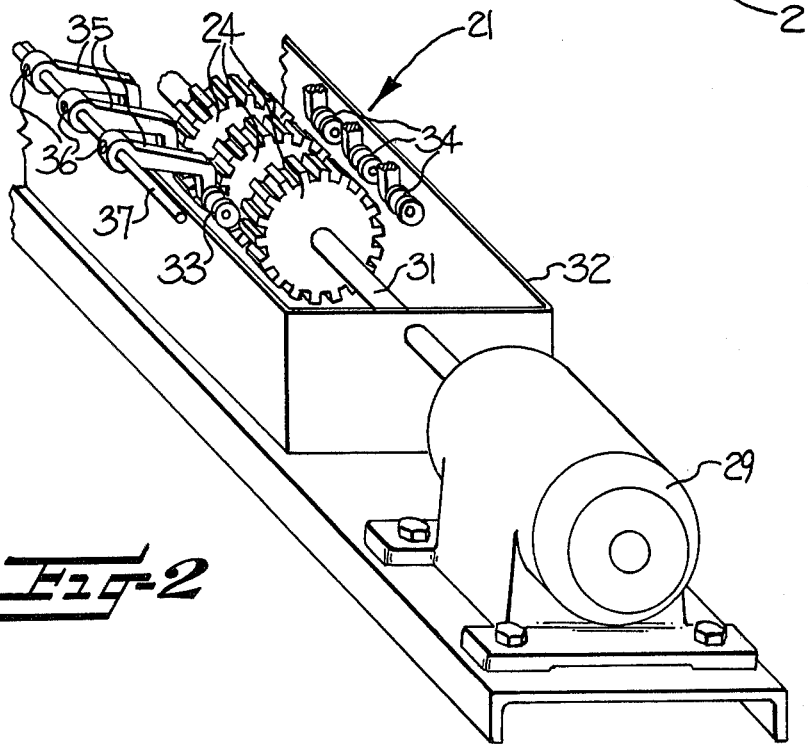
FIG. 2 is a perspective view of the apparatus for applying a liquid to the running yarn and in accordance with the present invention.

The apparatus 21 for applying liquid to the running yarn is located adjacent the bottom of the machine, and is illustrated in more detail in FIG. 2. It will be understood that the apparatus 21 is essentially identical to the apparatus 21*a* which is located immediately adjacent the yarn take-off mechanism 9.

The apparatus 21 comprises a horizontal shaft 31 rotatably mounted to the frame and extending horizontally along the entire length of the machine. A plurality of rollers 24 are fixedly mounted to the shaft 31, with one roller 24 being associated with each of the false twisting stations. A tray 32 is disposed immediately below the shaft, and is adapted to receive a quantity of the liquid to be applied to the running yarn, with the lower portions of the rollers 24 being immersed in the liquid. The shaft 31, and thus the rollers 24 are rotated by a variable speed motor 29, and such that the liquid is carried on the circumferential surface of the rollers. The liquid is thereby transferred to the running yarn which moves in a generally tangential direction along the top portion of the circumferential surface of a roller. The motor 29 is typically designed to rotate the roller so as to obtain a peripheral speed of at least about one meter per minute, and the linear speed of the running yarn is preferably at least about fifty times the peripheral speed of the rollers.

The components indicated by the numerals 13 to 20 and 22 relate to a yarn guide device for threading and guiding the yarn between the heater plate 6 and cooling plate 7. These components are further illustrated and described in the commonly owned U.S. Patent to Kubler, U.S. Pat. No. 4,058,961.

A pair of yarn guides or rollers 33 and 34 are mounted immediately upstream and downstream respectively of each wetting roller 24, with the yarn guide 33 being adjustable in elevation with respect to the shaft 31 and roller 24. This adjustability permits the extent of the tangential contact between the yarn and lands of the roller, i.e. the looping angle of the yarn, to be adjusted. Preferably, this looping angle will range between about 10 and 30 degrees of the circumferential surface. Yarn guide 33 is preceded by a yarn detector 28, which monitors the presence of the yarn, and in the absence of a yarn, causes the yarn to be severed by the cutter 30 which is positioned adjacent the delivery packages 3.

A crimped yarn with a particularly high elasticity will normally be directed from the take-off mechanism 9 across the adjacent wetting apparatus **21*a* and to the take-up package 12, whereas a bulky yarn which is more similar to natural fiber may be conducted through the heater 10 and then across the wetting apparatus 21**.

In the illustrated embodiment, the yarn guides 33 are adjustably positioned with respect to the wetting roller by means of an arm 35 so that the looping angle of the yarn on the wetting roller 24 can be varied. A set screw 36 holds each arm 35 in its desired position on a stationary shaft 37 which extends along the length of the machine. It is also possible that the shaft 37 may be rotatably attached to the machine so that all yarn guides 33 of a machine may be concurrently adjusted. Similarly, the yarn guides 34 may be either adjustably or rigidly mounted as desired.

FIG. 2 does not illustrate the yarn detectors 28, but in this regard, it should be noted that the yarn detectors 28 may be mounted in place of the yarn guides 33 or 34. It should be noted that the present invention is not restricted to the use of a yarn detector, and the present invention is useful even where such detectors are not used. In other words, the present invention is useful even when the problem of inadvertent signals from the detectors is not present, since sagging of the yarn can in any event result in lapping and ends down, as described above.

Figure 3:
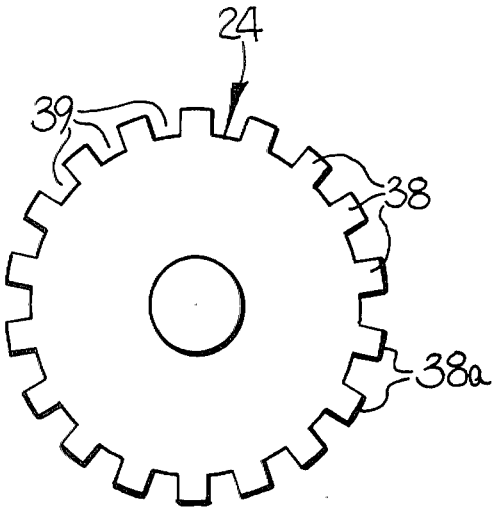
FIG. 3 is a side elevation view of the wetting roller of the apparatus illustrated in FIG. 2.

In the embodiment illustrated in FIG. 3, the circumferential surface of the wetting roller 24 is in the form of a toothed belt pulley having eighteen teeth 38, and accordingly eighteen intervening gaps or grooves 39, which extend laterally across the surface. The top surfaces or lands of the teeth are indicated by the numeral **38*a*. The lands 38*a* collectively conform to the curvature of a circle in cross-section, and the interface between each adjacent land and groove extends radially in cross-section. Preferably, the grooves 39 occupy more than one-third of the entire circumferential surface of the roller, but less than two-thirds thereof, and in the embodiment of FIG. 3, the lands 38*a* and grooves 39** are of substantially equal circumferential extent. As a specific example, the lands and grooves each extend between about two and eight millimeters, and the lands preferably extend at least about three millimeters. Also, the lands and grooves extend fully across the circumferential surface of the roller in a direction parallel to the rotational axis of the roller.

Figure 4:
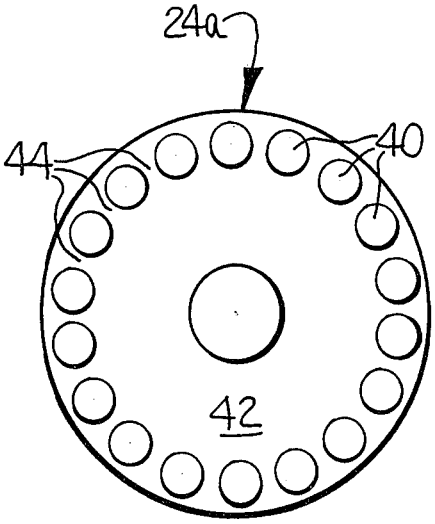
FIGS. 4 through 7 are side elevations view illustrating four other embodiments of a wetting roller in accordance with the present invention.
Figure 5:
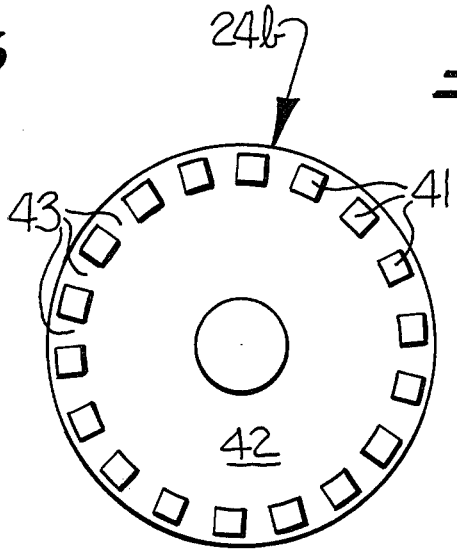

FIG. 4 shows an additional embodiment of the wetting roller **24*a*, and wherein the lands and grooves are defined by a plurality of rods 40 mounted in circumferentially spaced apart relation. The rods 40 are round in cross-section and define grooves or gaps 44 therebetween. FIG. 5 illustrates an embodiment wherein the roller 24*b* includes rods 41 having a generally rectangular cross-section, with grooves or gaps 43 therebetween. Rods 40 or 41 may be attached between two end pulleys 42 mounted coaxially on a shaft and immediately adjacent to each other, and such that the gaps or grooves 44, 43** respectively, are formed therebetween. The rods may extend either parallel to the axis of the shaft, or inclined with respect thereto.

Figure 6:
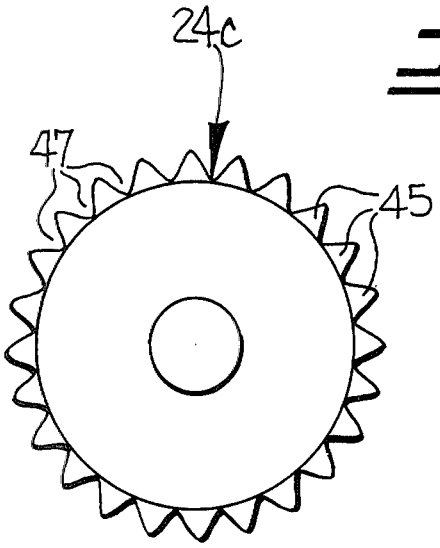
Figure 7:
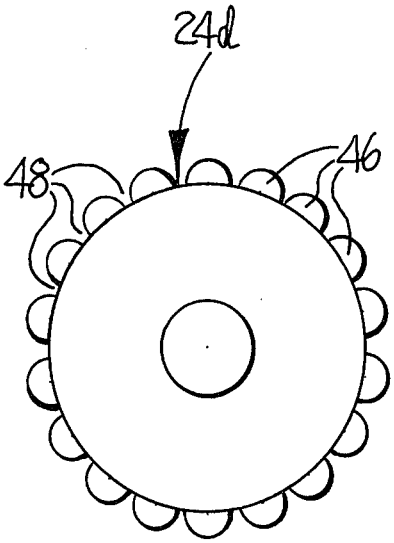

FIG. 6 illustrates a further embodiment of a wetting roller **24*c* which has rods 45 in the form of triangles in cross-section, with the corners of such triangles forming the outer lands. FIG. 7 illustrates still another embodiment of a roller 24*d*, which has rods 46 having a semicylindrical configuration, with the rounded surfaces thereof forming the lands. The rods 45 or 46 may, for example, be welded to a smooth pulley in such a manner that they form the gaps or grooves 47, 48** respectively, therebetween.

To further illustrate the operation of the wetting roller according to the present invention, there is presented below certain test results. In these tests, the outside diameter of the wetting roller was 69 mm, the root diameter of the teeth measured 65 mm, and the roller had 23 teeth. The ratio of the sum of the length of the lands to the sum of the length of the grooves was one to one. Also, the yarn speed was 600 m per minute.

| Test | Looping Angle | Speed (RPM) | Application |
|---|---|---|---|
| 1 | 10° | 12 | 1.06% |
| 2 | 10° | 20 | 2.46% |
| 3 | 20° | 12 | 1.19% |
| 4 | 20° | 20 | 2.96% |
| 5 | 30° | 12 | 1.29% |
| 6 | 30° | 20 | 3.67% |

In additional tests, it was possible to extensively vary the liquid application, for example between about 0.1% to 9.5%, by varying the roller speed and the looping angle. In these tests, sagging of the yarn in the area of the yarn detector was essentially avoided, so that the yarn detector did not trigger an erroneous signal.

In a similar test, a roller having 43 teeth and a 69 mm diameter was used. This roller also performed satisfactorily at various speeds and looping angles. However, during the test special attential had to be given to ensure that no sagging of the yarn occured in the area of the wetting roller.

An additional test showed that the amount of liquid applied to the yarn for a given diameter of the wetting roller is dependent on the number of lands (or teeth) and the length of the lands. In this regard, a wetting roller having a 69 mm outside diameter was used, the speed being 13 rpm and the ratio of the length of the lands to the length of the grooves being one to one. The following results were obtained:

| Number of Teeth | Amount of Fluid Applied In Percent of Yarn Weight |
|---|---|
| 23 | 2.70 |
| 28 | 1.55 |
| 43 | 1.22 |

A particularly positive and surprising effect was found in the tests concerning the uniformity of the yarn tension. These tests indicated that, when using a wetting roller according to the invention, fluctuations in the yarn tension downstream of the wetting roller were considerably less than in the case of smooth conventional rollers. In an exemplary test the following results were obtained, with the letter p representing the German pond unit of force:

| | Average Yarn Tension Before Roller/ | Average Yarn Tension After Roller/cN | Yarn Tension Fluctuation After Roller |
|---|---|---|---|
| Smooth Surface | 2.0 | 10 | 15 (5 to 20 p) |
| 23 Teeth | 4.0 | 10 | 7 (8 to 15 p) |
| 43 Teeth | 4.0 | 10 | 8 (8 to 16 p) |

In the drawings and specification, there has been set forth a preferred embodiment of the invention, and although specific terms are employed, they are used in a generic and descriptive sense only and not for purposes of limitation.

That which is claimed is:

1. A false twist yarn crimping machine having a frame, means for mounting a plurality of yarn delivery bobbins to the frame, means for feeding each of said yarns through one of a plurality of false twisting stations disposed in side-by-side relation along the length of said frame, means for winding the yarns received from said false twisting stations onto take-up spools, and means for applying a liquid to each of the yarns upon leaving the false twisting station and prior to being wound onto the take-up spools, the improvement wherein said means for applying a liquid to each of the yarns comprises a shaft rotatably mounted to said frame and extending horizontally along the length thereof, a roller fixedly mounted to said shaft in association with each of said false twisting stations, each roller having a circumferential surface composed of alternating lands and grooves in the circumferential direction, means for rotating said shaft and thus each of said rollers, and so that the linear speed of the advancing yarn is substantially greater than the peripheral speed of said rollers, means for guiding each yarn so as to contact the lands of the associated roller in a generally tangential direction and along a predetermined portion only of the circumferential surface of the associated roller, and means for applying a liquid to the circumferential surface of each roller during rotation thereof, whereby movement of the running yarn along the circumferential surface of the rotating roller results in the liquid being delivered to the yarn with low frictional resistance being imparted to the yarn.

2. The false twist yarn crimping machine as defined in claim 1 further comprising means disposed immediately upstream of the associated liquid applying means for monitoring the tension of each yarn.

3. The false twist yarn crimping machine as defined in claim 2 further comprising means operatively associated with said monitoring means for terminating the advance of any yarn having a tension below a predetermined level.

4. The false twist yarn crimping machine as defined in claim 1 wherein said yarn feeding means is adapted to advance the yarns at a linear speed which is at least about fifty times the peripheral speed of said rollers.

5. The false twist yarn crimping machine as defined in claim 1 wherein said means for rotating said shaft includes means for varying the rotational speed thereof.

6. The false twist yarn crimping machine as defined in claim 1 wherein said yarn guiding means comprises a pair of yarn guides associated with each roller, and means mounting each pair of guides adjacent respective sides of the associated roller and with at least one guide of each pair being concurrently adjustable so as to permit the extent of the contact between the yarns and rollers to be selectively varied.

* * * * *